US005162760A

United States Patent [19]

Phillips et al.

[11] Patent Number: 5,162,760

[45] Date of Patent: Nov. 10, 1992

[54] DIELECTRIC BLOCK FILTER WITH ISOLATED INPUT/OUTPUT CONTACTS

[75] Inventors: James R. Phillips; Ali A. Tootoonchi, both of Albuquerque, N. Mex.

[73] Assignee: Motorola, Inc., Schaumburg, Ill.

[21] Appl. No.: 811,154

[22] Filed: Dec. 19, 1991

[51] Int. Cl.[5] ..... H01P 1/202

[52] U.S. Cl. ..... 333/206; 333/222

[58] Field of Search ..... 333/202, 204, 206, 207, 333/219, 222

[56] References Cited

U.S. PATENT DOCUMENTS 4,673,902 6/1987 Takeda et al. ..... 333/202

4,879,533 11/1989 de Muro et al. ..... 333/206

4,937,542 6/1990 Nakatuka ..... 333/202

FOREIGN PATENT DOCUMENTS 0043904 2/1987 Japan ..... 333/202

0006103 1/1991 Japan ..... 333/206

*Primary Examiner*—Paul M. Dzierzynski

*Assistant Examiner*—Seung Ham

*Attorney, Agent, or Firm*—Joseph P. Krause

[57] ABSTRACT

Improved frequency characteristics can be achieved by using input/output pads on a surface mount block filter which pads are mounted on mesas formed by troughs cut through the dielectric material and metallization.

9 Claims, 1 Drawing Sheet

DIELECTRIC BLOCK FILTER WITH ISOLATED INPUT/OUTPUT CONTACTS

FIELD OF THE INVENTION

This invention relates generally to electrical filters, and relates particularly to so-called ceramic filters.

BACKGROUND OF THE INVENTION

Ceramic filters are well known in the electrical art and at least one ceramic filter is described in U.S. Pat. No. 4,431,977 for a "Ceramic Bandpass Filter".

Prior art ceramic bandpass filters are constructed from blocks of ceramic material, are relatively large and are typically coupled to other electronic circuitry through discrete wires, cables, and pins coupled to connection points on external surfaces of the blocks.

It is also well known that some major objectives in electronic designs are reduced physical size, increased reliability, improved manufacturability, and reduced manufacturing costs. To achieve these somewhat conflicting objectives, electronic circuits are increasingly being manufactured using so-called surface-mount techniques.

Surface-mount is a manufacturing technique by which electronic components are attached to a circuitry substrate without using metallic leads that extend from a package or electronic component. A surface mountable ceramic block filter is described in co-pending application Ser. No. 07/661,025 for a "Monolithic Surface Mount Ceramic Bandpass Filter" filed Feb. 25, 1991, which application, as is this application, is assigned to Motorola, Inc.

In manufacturing a ceramic block filter, prior art ceramic block filter manufacturing techniques have typically used abrasive methods to remove metallization or have used various screen printing techniques to apply conductive material onto the various surfaces of the ceramic block in order to electrically tune the filter. These prior art techniques depend upon very close tolerance abrading or very fine patterning, both of which are difficult to achieve in a manufacturing environment.

In addition to patterning metallization on a block to tune or adjust its electrical characteristics, input-output contacts or pads, which are typically isolated areas of conductive material, must also be formed on at least one side of the block. Careful abrasion and/or patterning to produce very small dimensioned input/output pads as well as top patterns and very fine line screen printing is difficult and costly to achieve.

In a surface mount ceramic block filter, in which the input/output pads for a block filter are required to be closely mated to the supporting substrate, an improved structure for providing connections or input/output terminals to a block filter would be an improvement over the prior art.

SUMMARY OF THE INVENTION

There is provided herein a surface mountable dielectric block filter that is comprised of a block of dielectric material having at least one planar side surface upon which is located at least one input/output pad. The input/output pad is comprised of an electrically isolated area of conductive material disposed on the upper surface of a mesa of dielectric material, where the mesa is formed from dielectric material.

In the preferred embodiment, a mesa is formed by a trough in the block, on one side of the block, (the side of the block that is surface mounted) which trough circumscribes an area that defines the area of the input/output pad. The trough has a predetermined width and depth and, in the preferred embodiment, is formed in the block of dielectric material after the block is metallized (coated with a layer of conductive material).

The trough, the depth of which extends through both the conductive material coating the surface of the block and dielectric material, locates an input/output pad comprised of the conductive material on the upper surface of a mesa, which mesa is defined by the dielectric material circumscribed by the trough. The trough, which forms an air gap between metallization on the mesa and metallization on the surface of the block, better isolates metallization on the mesa from the metallization on the block and has been found to improve the electrical characteristics of the block filter.

DESCRIPTION OF A PREFERRED EMBODIMENT

Figure 1:
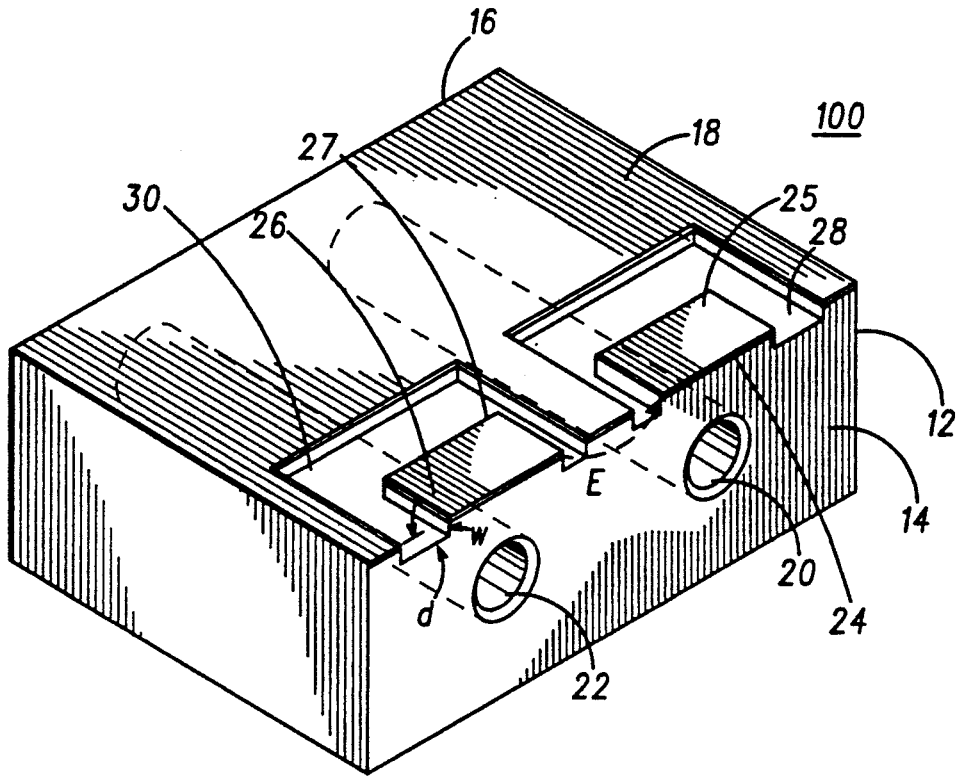
FIG. 1 shows a perspective view of an improved surface mountable dielectric block filter showing input/output pads on mesas.

FIG. 1, shows a perspective view of a block of dielectric material (12) that has at least top and bottom surfaces (14 and 16) respectively, which surfaces are substantially planar. While the block (12) shown in FIG. 1 is depicted as also having 4 planar side surfaces, for purposes of surface mount manufacturing techniques the invention requires that at least one side surface be substantially planar, such as the side surface that is shown and identified by reference numeral 18 in FIG. 1.

The block (12) shown in FIG. 1 is shown with two holes (20 and 22) that extend completely through the block, intersecting both the top and bottom surfaces (14 and 16) respectively. In manufacturing a block filter, all of the exposed surfaces of the block (12), with the likely exception of the top surface (14), are coated with a conductive material, which material is typically a silver-based material but might also include gold, copper, or some other conductive materials.

The improvement to the block filter is depicted by the location of the input/output pads (25 and 26) which are layers of conductive material disposed on the upper surfaces of mesas (24 and 27). The mesas are formed by the troughs (28 and 30) cut through the metallization (conductive material coating the surface 18) and cut into the dielectric material of the block, which surround the dielectric material forming the mesas (24 and 26).

In the preferred embodiment the block is initially formed in the shape of a parallel piped with the surface 18 being substantially flat. A layer of conductive material is deposited on the surfaces of the block and after the layer is successfully cured, slots forming the troughs (28 and 30) are cut by any suitable milling machine, such as a small high speed router for example, such that not only is the conductive material coating the surfaces of the block removed, dielectric material is also cut away through the block itself.

Since both the conductive material coating the block and dielectric material are removed from the block in the areas surrounding the mesas (24 and 26) what is left is the conductive material, (25 and 27) as shown, which provides input/output pads that can be used to capacitively couple signals to the metallization lining the holes (20 and 22).

As shown in FIG. 1, the upper surfaces of the mesas (25 and 27) are substantially coplanar with the surface of the substantially planar side surface (18) because the troughs (28 and 30) are cut through what has previously been a flat surface. Alternate embodiments of the invention would, of course, include mesas that have upper surfaces which are either above or below the plane in which the planar surface (18) resides.

Figure 2:
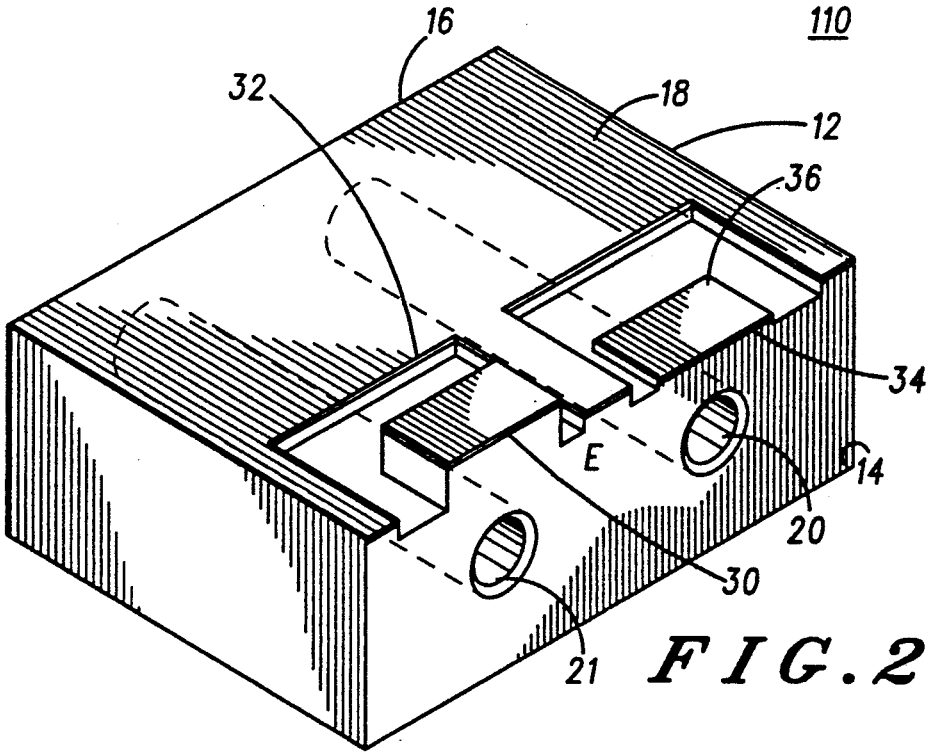
FIG. 2 shows a perspective view of an alternate embodiment of a dielectric block filter showing alternate embodiments of input/output pads on alternate embodiments of the mesas.

Turning to FIG. 2, there is shown an alternate embodiment of a dielectric block filter that is comprised of a block of dielectric material (12) having top and bottom surfaces (14 and 16) through which extend holes (20 and 21). In either FIG. 1 or FIG. 2, when the exterior surfaces of the block (12) are coated with conductive material and that when this material is substantially removed from the top surface (14) leaving the material lining the holes (20 and 21) electrically isolated from the rest of the metallization, the conductive material lining the holes (20 and 21) forms foreshortened coaxial resonators. These shortened coaxial resonators are well known in the art as shorted lenghts of transmission lines.

In the embodiment shown in FIG. 2, one of the mesas (30) is shown as extending above the level of the planar side surface (18). This elevated mesa might be accomplished by any number of manufacturing techniques, including for example the removal of material from the entire side of the block (18) except for the mesa, such that the height of the mesa (30) corresponds to the starting thickness of the block (12).

Alternatively, mesas might be below the level of the planar side surface (18), such as the mesa (34) shown in FIG. 2. Either mesa (30 or 34) has its upper surfaces coated with the conductive material (32 and 36) to provide a contact surface such that when the block (either block shown in FIG. 1 or FIG. 2) is inverted from its orientation as shown in the FIGS., it will mate with and couple to corresponding contact pads on a circuit board or other substrate to which the filter is to be attached.

While the preferred embodiment contemplated mesas with upper surfaces that are co-planar with the remainder of the planar side surface (18) the embodiment shown in FIG. 2 might provide advantages in different applications. Using input/output pads (I/O) on mesas has been empirically determined to improve the performance characteristics of the block filter. The material that is removed from the side of the block to form the trough has a much higher dielectric constant than air and provides more capacitive coupling between the metallization of the I/O pad and the remaining metallization on the block, which metallization is typically at ground or other reference potential. By means of the trough, (28 and 30) capacitive coupling between the metallization on the upper surfaces of the mesas (25 and 27) and the rest of the side is reduced by the air gap formed by the volume of the trough (28 or 30). This air gap provided by the depth and width of the trough, which depth and width are user definable and will depend in large part on the physical dimensions of the block, provide an improved capacitive isolation of the input/output pads (25 and 27) from the exterior surfaces of the block which surfaces are ordinarily grounded.

What is claimed is:

1. A dielectric block filter comprised of:

a block of dielectric material having at least top and bottom surfaces and at least one substantially planar side surface substantially orthogonal to said top and bottom surfaces, said block having at least one hole therethrough, extending between said top and bottom surfaces, exterior surfaces of said block of dielectric material and interior surfaces of said at least one hole being substantially covered with a conductive material, except for said top surface, which is substantially uncoated;

a first input-output pad comprised of an electrically isolated area of conductive material disposed on a mesa of dielectric material on said substantially planar side surface:

a second input-output pad comprised of an electrically isolated area of conductive material disposed on a mesa of dielectric material on said substantially planar side surface.

2. The dielectric block filter of claim 1 where the surface of said mesa is substantially co-planar with the substantially planar side surface of the block and is formed by trough formed in said block of dielectric material, said trough having a finite depth and width and substantially surrounding said mesa.

3. The dielectric block filter of claim 1 where the surface of said mesa is elevated above the substantially planar side surface of the block.

4. The dielectric block filter of claim 1 where the surface of said mesa is below the substantially planar side surface of the block.

5. The dielectric block filter of claim 1 where said dielectric material is ceramic.

6. A dielectric block filter comprised of:

a block of dielectric material having at least top and bottom surfaces and at least one substantially planar side surface and having at least first and second holes which extend between said top and bottom surfaces, with the exception of said top surface, exterior surfaces of said block of dielectric material and interior surfaces of said first and second holes being substantially covered with a conductive material, said conductive material lining said holes and said conductive material on said exterior surfaces forming first and second resonators:

first input-output pad comprised of an electrically isolated area of conductive material disposed on the surface of a first mesa of dielectric material, said first mesa being formed on the substantially planar side surface by a trough formed through the conductive material coating said block and partially through the dielectric material of the block and substantially surrounding the location of said first input-output pad, said trough having a finite depth and width;

second input-output pad comprised of an electrically isolated area of conductive material disposed on the surface of a second mesa of dielectric material, said second mesa being formed on the substantially planar side surface by a trough formed through the conductive material coating said block and partially through the dielectric material of the block and substantially surrounding the location of said second input-output pad, said trough having a finite depth and width.

7. The dielectric block filter of claim 6 where said first and second mesas have upper surfaces which upper surfaces are substantially co-planar with said at least one substantially planar side surface.

8. The dielectric block filter of claim 6 where said first and second mesas have upper surfaces which upper surfaces are not co-planar with said at least one substantially planar side surface.

9. A ceramic block filter comprised of:

a substantially parallelpiped block of ceramic having at least top and bottom substantially planar surfaces and at least one substantially planar side surface and having at least first and second holes therethrough that extend between said top and bottom surfaces, except of said top surface, exterior surfaces of said block of ceramic and interior surfaces of said first and second holes being substantially coated with a conductive material;

first input-output pad comprised of an electrically isolated area of conductive material disposed on the surface of a first mesa of ceramic formed from said block of ceramic, said first mesa being formed on the substantially planar side surface by the removal of conductive material and ceramic material of said block of material, from a first volume surrounding said first input-output pad, conductive material of said first input-output pad being electrically isolated from other conductive material on said block of ceramic;

second input-output pad comprised of an electrically isolated area of conductive material disposed on the surface of a second mesa of ceramic of said block of dielectric material, said second mesa being formed on the substantially planar side planar side surface by the removal of conductive material and ceramic material of said block of material, from a second volume surrounding said second input-output pad, conductive material of said second input-output pad being electrically isolated from other conductive material on said block of ceramic.

* * * * *